United States Patent [19]

Hays et al.

[11] Patent Number: 5,031,570

[45] Date of Patent: Jul. 16, 1991

[54] PRINTING APPARATUS AND TONER/DEVELOPER DELIVERY SYSTEM THEREFOR

[75] Inventors: Dan A. Hays, Fairport; William H. Wayman, Ontario, both of N.Y.

[73] Assignee: Xerox Corporation, Stamford, Conn.

[21] Appl. No.: 424,482

[22] Filed: Oct. 20, 1989

[51] Int. Cl.[5] ..... G03G 15/09

[52] U.S. Cl. ..... 118/654; 355/261; 355/328; 355/251; 430/122

[58] Field of Search ..... 355/261, 251, 263, 266, 355/328, 247; 430/35, 53, 120, 122; 118/654, 655–658

[56] References Cited

U.S. PATENT DOCUMENTS

| | | | |
|---|---|---|---|
| 3,457,900 | 7/1969 | Drexler | 118/637 |
| 3,900,001 | 8/1975 | Fraser et al. | 118/637 |
| 4,078,929 | 3/1978 | Gundlach | 96/1.2 |
| 4,308,821 | 1/1982 | Matsumoto et al. | 118/645 |
| 4,422,749 | 12/1983 | Hoshino et al. | 355/261 X |
| 4,431,296 | 2/1984 | Haneda et al. | 355/265 X |
| 4,478,505 | 10/1984 | Tashiro | 355/3 DD |
| 4,486,089 | 12/1984 | Itaya et al. | 355/3 DD |
| 4,558,941 | 12/1985 | Nosaki et al. | 355/265 X |
| 4,568,955 | 2/1986 | Hosoya et al. | 346/153.1 |
| 4,598,991 | 7/1986 | Hosoya et al. | 355/265 X |
| 4,656,427 | 4/1987 | Dauphinee | 324/444 |
| 4,766,468 | 8/1988 | Hosono et al. | 355/261 X |
| 4,804,994 | 2/1989 | Sasaki et al. | 355/251 |
| 4,810,604 | 3/1989 | Schmidlia | 430/42 |
| 4,833,504 | 5/1989 | Parker et al. | 355/326 |
| 4,847,655 | 7/1989 | Parker et al. | 355/251 X |

FOREIGN PATENT DOCUMENTS 62-70881 4/1987 Japan .

*Primary Examiner*—R. L. Moses

[57] ABSTRACT

A scavengeless development system for use in highlight color imaging. AC biased electrodes positioned in close proximity to a magnetic brush structure carrying a two-component developer cause a controlled cloud of toner to be generated which noninteractively develops an electrostatic image. The two-component developer includes mixture of carrier beads and toner particles. By making the two-component developer magnetically tractable, the developer is transported to the development zone as in conventional magnetic brush development where the development roll or shell of the magnetic brush structure rotates about stationary magnets positioned inside the shell.

14 Claims, 3 Drawing Sheets

PRINTING APPARATUS AND TONER/DEVELOPER DELIVERY SYSTEM THEREFOR

BACKGROUND OF THE INVENTION

This invention relates generally to the rendering of latent electrostatic images visible using multiple colors of dry toner or developer and more particularly to a development apparatus including a plurality of developer housings which minimize scavenging and redevelopment of the first developed image by successive developer housings.

The invention can be utilized in the art of xerography or in the printing arts. In the practice of conventional xerography, it is the general procedure to form electrostatic latent images on a xerographic surface by first uniformly charging a photoreceptor. The photoreceptor comprises a charge retentive surface. The charge is selectively dissipated in accordance with a pattern of activating radiation corresponding to original images. The selective dissipation of the charge leaves a latent charge pattern on the imaging surface corresponding to the areas not exposed by radiation.

This charge pattern is made visible by developing it with toner. The toner is generally a colored powder which adheres to the charge pattern by electrostatic attraction.

The developed image is then fixed to the imaging surface or is transferred to a receiving substrate such as plain paper to which it is fixed by suitable fusing techniques.

The concept of tri-level, highlight color xerography is described in U.S. Pat. No. 4,078,929 issued in the name of Gundlach. The patent to Gundlach teaches the use of tri-level xerography as a means to achieve single-pass highlight color imaging. As disclosed therein the charge pattern is developed with toner particles of first and second colors. The toner particles of one of the colors are positively charged and the toner particles of the other color are negatively charged. In one embodiment, the toner particles are supplied by a developer which comprises a mixture of triboelectrically relatively positive and relatively negative carrier beads. The carrier beads support, respectively, the relatively negative and relatively positive toner particles. Such a developer is generally supplied to the charge pattern by cascading it across the imaging surface supporting the charge pattern. In another embodiment, the toner particles are presented to the charge pattern by a pair of magnetic brushes. Each brush supplies a toner of one color and one charge. In yet another embodiment, the development systems are biased to about the background voltage. Such biasing results in a developed image of improved color sharpness.

In highlight color xerography as taught by Gundlach, the xerographic contrast on the charge retentive surface or photoreceptor is divided into three levels, rather than two levels as is the case in conventional xerography. The photoreceptor is charged, typically to 900v. It is exposed imagewise, such that one image corresponding to charged image areas (which are subsequently developed by charged-area development, i.e. CAD) stays at the full photoreceptor potential ($V_{cad}$ or $V_{ddp}$). The other image is exposed to discharge the photoreceptor to its residual potential, i.e. $V_{dad}$ or $V_c$ (typically 100v) which corresponds to discharged area images that are subsequently developed by discharged-area development (DAD) and the background areas exposed such as to reduce the photoreceptor potential to halfway between the $V_{cad}$ and $V_{dad}$ potentials, (typically 500v) and is referred to as $V_{white}$ or $V_w$. The CAD developer is typically biased about 100v closer to $V_{cad}$ than $V_{white}$ (about 600v), and the DAD developer system is biased about 100v closer to $V_{dad}$ than $V_{white}$ (about 400v).

The viability of printing system concepts such as tri-level, highlight color xerography requires development systems that do not scavenge or interact with a previously toned image. Since commercial development systems such as conventional magnetic brush development and jumping single component development interact with the image receiver, a previously toned image will be scavenged by subsequent development. Great care is required to optimize the development materials and process conditions for minimum interaction. Since the present commercial development systems are highly interactive with the image bearing member, there is a need for scavengeless or non-interactive development systems, particularly one which provides the inherent attributes of magnetic brush development without image disturbance.

It is known in the art to alter the magnetic properties of the magnetic brush in the second housing in order to obviate the foregoing problem. For example, there is disclosed in U.S. Pat. No. 4,308,821 granted on Jan. 5, 1982 to Matsumoto, et al, an electrophotographic development method and apparatus using two magnetic brushes for developing two-color images which do not disturb or destroy a first developed image during a second development process. This is because a second magnetic brush contacts the surface of a latent electrostatic image bearing member more lightly than a first magnetic brush and the toner scraping force of the second magnetic brush is reduced in comparison with that of the first magnetic brush by setting the magnetic flux density on a second non-magnetic sleeve with an internally disposed magnet smaller than the magnetic flux density on a first magnetic sleeve, or by adjusting the distance between the second non-magnetic sleeve and the surface of the latent electrostatic image bearing members. Further, by employing toners with different quantity of electric charge, high quality two-color images are obtained.

U.S. Pat. No. 3,457,900 discloses the use of a single magnetic brush for feeding developer into a cavity formed by the brush and an electrostatic image bearing surface faster than it is discharged thereby creating a roll-back of developer which is effective in toning an image. The magnetic brush is adapted to feed faster than it discharges by placement of strong magnets in a feed portion of the brush and weak magnets in a discharge portion of the brush.

U.S. Pat. No. 3,900,001 disclose an electrostatographic developing apparatus utilized in connection with the development of conventional xerographic images. Developer material is applied to a developer receiving surface in conformity with an electrostatic charge pattern wherein the developer is transported from the developer supply to a development zone while maintained in a magnetic brush configuration and thereafter, transported through the development zone magnetically unconstrained but in contact with the developer receiving surface.

As disclosed in U.S. Pat. No. 4,486,089 granted on Dec. 4, 1984 to Itaya, et. al. a magnetic brush developing apparatus for a xerographic copying machine or electrostatic recording machine has a sleeve in which a plurality of magnetic pieces are arranged in alternating polarity. Each piece has a shape which produces two or more magnetic peaks. The sleeve and the magnets are rotated in opposite directions. As a result of the above, it is alleged that a soft developer body is obtained, and density unevenness or stripping of the image is avoided.

U.S. Pat. No. 4,833,504 granted on May 23, 1989 to Parker et al discloses a magnetic brush developer apparatus comprising a plurality of developer housings each including a plurality of magnetic rolls associated therewith. The magnetic rolls disposed in a second developer housing are constructed such that the radial component of the magnetic force field produces a magnetically free development zone intermediate to a charge retentive surface and the magnetic rolls. The developer is moved through the zone magnetically unconstrained and, therefore, subjects the image developed by the first developer housing to minimal disturbance. Also, the developer is transported from one magnetic roll to the next. This apparatus provides an efficient means for developing the complimentary half of a tri-level latent image while at the same time allowing the already developed first half to pass through the second housing with minimum image disturbance.

U.S. Pat. No. 4,810,604 granted to Fred W. Schmidlin on Mar. 7, 1989 discloses a printing apparatus wherein highlight color images are formed without scavenging and re-development of a first developed image. A first image is formed in accordance with conventional (i.e. total voltage range available) electrostatic image forming techniques. A successive image is formed on the copy substrate containing the first image subsequent to first image transfer, either before or after fusing, by utilization of direct electrostatic printing. Thus, the '604 patent solves the problem of developer interaction with previously recorded images by forming a second image on the copy substrate instead of on the charge retentive surface on which the first image was formed.

U.S. Pat. No. 4,478,505 issued on Oct. 23, 1984 relates to developing apparatus for improved charging of flying toner. The apparatus disclosed therein comprises a conveyor for conveying developer particles from developer supplying means to a photoconductive body positioned to define a gap therebetween. A developer supplying passage for conveying developer particles is provided between the developer supplying means and the gap. The developer supplying passage is defined by the conveyor and an electrode plate provided with a predetermined interval with the conveyor. An alternating electric field is applied to the developer supplying passage by an A. C. power source to reciprocate the developer particles between the conveyor and the electrode plate thereby sufficiently and uniformly charging the developer particles by friction. In the embodiment disclosed in FIG. 6 of the '505 patent, a grid is disposed in a space between the photosensitive layer and a donor member.

U.S. Pat. No. 4,568,955 issued on Feb. 4, 1986 to Hosoya et al discloses a recording apparatus wherein a visible image based on image information is formed on an ordinary sheet by a developer. The recording apparatus comprises a developing roller spaced at a predetermined distance from and facing the ordinary sheet and carrying the developer thereon, a recording electrode and a signal source connected thereto, for propelling the developer on the developing roller to the ordinary sheet by generating an electric field between the ordinary sheet and the developing roller according to the image information, a plurality of mutually insulated electrodes provided on the developing roller and extending therefrom in one direction, an A. C. and a D. C. source are connected to the electrodes, for generating an alternating electric field between adjacent ones of the electrodes to cause oscillations of the developer found between the adjacent electrodes along electric lines of force therebetween to thereby liberate the developer from the developing roller.

U.S. Pat. No. 4,656,427 granted to Hosaka et al on Mar. 31, 1987 discloses a method and apparatus wherein a layer of developer which is a mixture of insulative, magnetic particles and insulative toner particles is carried on the surface of a developer sleeve forming part of a magnetic brush. A latent image bearing member carrying an image to be developed is moved relative to the magnetic brush. The brush is spaced from the image bearing member and an AC field is formed across the space to effect toner transfer to the image and nonimage areas and to effect a back transfer of excessive toner.

Japanese publication 62-70881 discloses a toner separating means using a plurality of electrically biased grid wires disposed intermediate a magnet brus developer roll and an imaging surface. The two-component developer is triboelectrified and magnetic carrier is removed from the outer periphery of a sleeve by the action of the north and south poles of the magnetic poles of the magnetic brush.

U.S. patent application Ser. No. 07/171,062 filed in the name of Hays et al and assigned to the same assignee as the instant application discloses a scavengeless development system in which toner detachment from a donor and the concomitant generation of a controlled powder cloud is obtained by AC electric fields supplied by self-spaced electrode structures positioned within the development nip. The electrode structure is placed in close proximity to the toned donor within the gap between the toned donor and image receiver, self-spacing being effected via the toner on the donor. Such spacing enables the creation of relatively large electrostatic fields without risk of air breakdown.

BRIEF SUMMARY OF THE INVENTION

Briefly, the present invention relates to a scavengeless development system in which AC biased electrodes in close proximity to a two-component developer form a controlled cloud of toner for noninteractive development of an electrostatic image. The two-component developer comprises mixture of carrier beads and toner particles. A scavengeless development system based on AC biased electrodes in self-spaced contact with a toned donor roll was described earlier in connection with the '062 application. By making the two-component developer magnetically tractable, the developer is transported to the development zone as in conventional magnetic brush development where the development roll or shell rotates about stationary magnets positioned inside the shell.

Whereas in conventional magnetic brush development a high radial magnetic field is provided in the development zone to form a brush of developer that contacts the image receiver, the scavengeless two-component development system of the present invention utilizes a tangential or low magnetic field to prevent physical contact between the developer and receiver. A plurality of AC biased electrodes are contemplated for effective toner release from the carrier beads for formation of a toner cloud. Toner particles forming the toner cloud are then moved across the gap between the biased electrodes and the image receiver by means of a dc voltage applied therebetween.

Typical electrodes comprise conductive wires with diameters of 2 to 10 mils. A typical AC bias of 600 to 1000 volts peak at a frequency of 1 to 10 kHz is applied to the electrodes (or to the roll with wires at a DC bias) which are in close proximity to a layer of insulative two-component developer. Conductive two-component developer could also be used provided the electrodes are overcoated with a sufficiently resistive yet relaxable layer.

Auxiliary unbiased wires placed within the developer layer and spaced between the AC biased wires provide developer agitation to provide a new supply of toner for each biased electrode and dissipate any space charge electric field in the developer due to toner development.

A noteworthy development characteristic is the uniformity of the solid areas developed with a controlled toner cloud. Toner cloud development of lines is characterized by line narrowing for low development potentials of comparable magnitude to the background cleaning potential. For higher line potentials, the line width is a more faithful representation of the electrostatic image.

Rapid on and off development switching without mechanically altering the spacing between the development roll and image receiver is desired for many system level concepts. Development switching with the Scavengeless Two-Component Development system of the present invention is obtained by simultaneously turning on and off the development roll drive and AC wire bias.

While the use of nonmagnetic toner has been described which is bright color compatible a developer with magnetic toner is also compatible with our invention. A system based on magnetic toner would enable Magnetic Image Character Recording (MICR) imaging. Magnetic toner could also improve system latitude and control airborne dirt.

DETAILED DESCRIPTION OF THE PREFERRED EMBODIMENT OF THE INVENTION

Figure 1A:
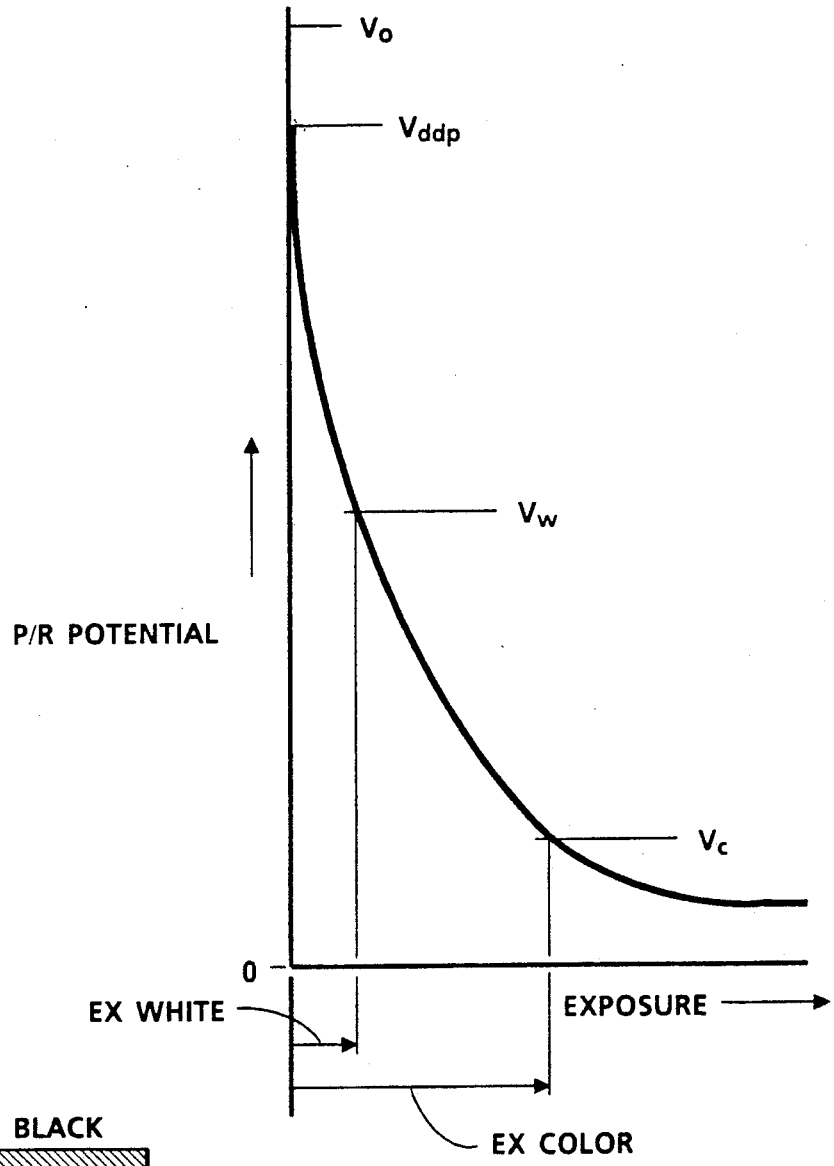
FIG. 1*a* is a plot of photoreceptor potential versus exposure illustrating a tri-level electrostatic latent image.
Figure 1B:
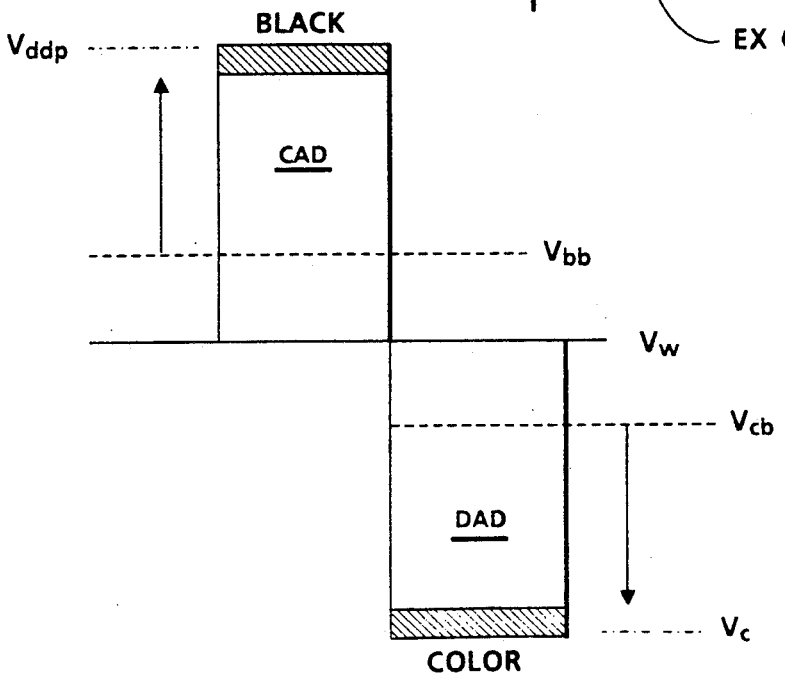
FIG. 1*b* is a plot of photoreceptor potential illustrating single pass, highlight color latent image characteristics.

For a better understanding of the concept of tri-level, highlight color imaging, a description thereof will now be made with reference to FIGS. 1*a* and 1*b*. FIG. 1*a* illustrates the tri-level electrostatic latent image in more detail. Here $V_0$ is the initial charge level, $V_{ddp}$ the dark discharge potential (unexposed), $V_w$ the white discharge level and $V_c$ the photoreceptor residual potential (full exposure).

Color discrimination in the development of the electrostatic latent image is achieved when passing the photoreceptor through two developer housings in tandem or in a single pass by electrically biasing the housing to voltages which are offset from the background voltage $V_w$, the direction of offset depending on the polarity or sign of toner in the housing. One housing (for the sake of illustration, the second) contains developer with black toner having triboelectric properties such that the toner is driven to the most highly charged ($V_{ddp}$) areas of the latent image by the electrostatic field between the photoreceptor and the development rolls biased at $V_{bb}$ (V black bias) as shown in FIG. 1*b*. Conversely, the triboelectric charge on the colored toner in the first housing is chosen so that the toner is urged towards parts of the latent image at residual potential, $V_c$ by the electrostatic field existing between the photoreceptor and the development rolls in the first housing at bias voltage $V_{cb}$ (V color bias).

Figure 2:
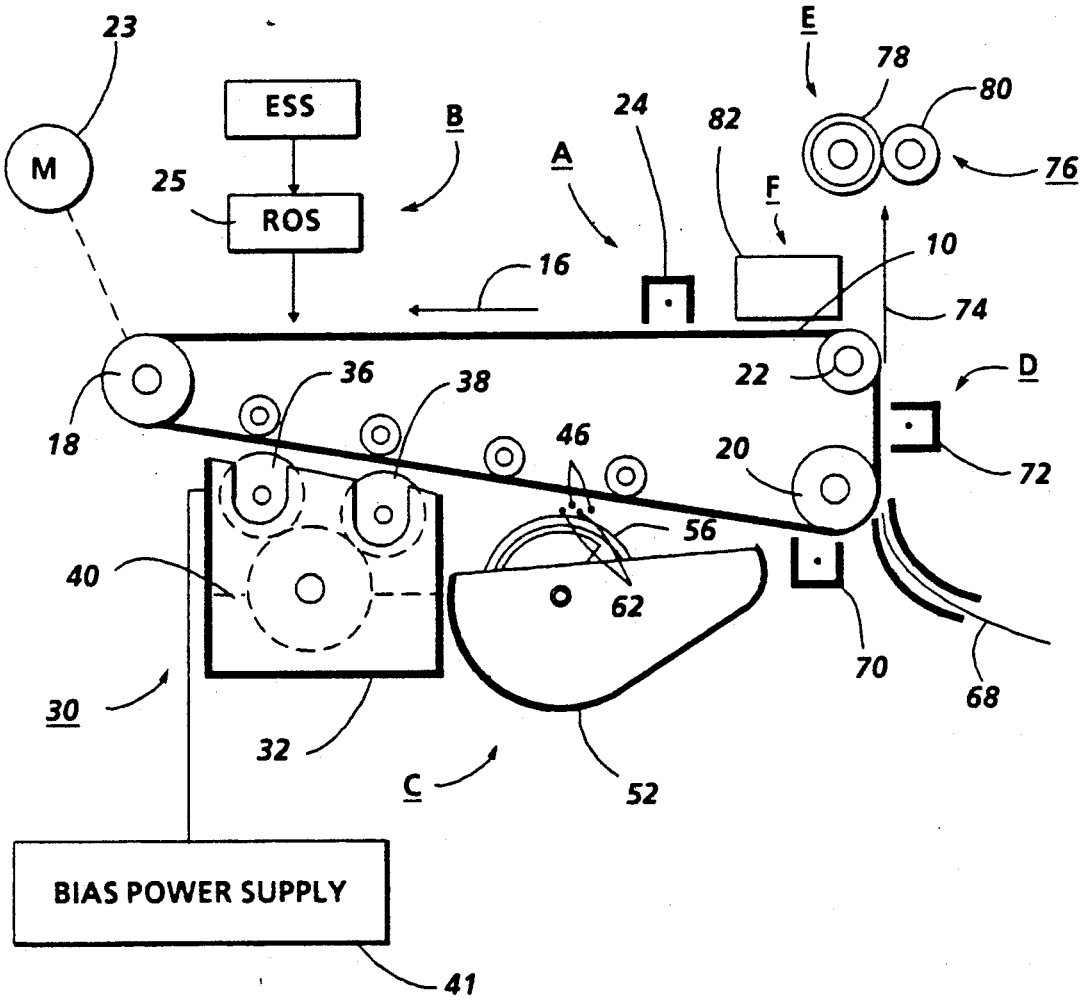
FIG. 2 is schematic illustration of a printing apparatus incorporating the inventive features of our invention.

As shown in FIG. 2, a highlight color printing machine in which our invention may be utilized comprises a charge retentive member in the form of a photoconductive belt 10 consisting of a photoconductive surface and an electrically conductive substrate and mounted for movement past a charging station A, an exposure station B, developer station C, transfer station D and cleaning station F. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used as a drive roller and the latter of which can be used to provide suitable tensioning of the photoreceptor belt 10. Motor 23 rotates roller 18 to advance belt 10 in the direction of arrow 16. Roller 18 is coupled to motor 23 by suitable means such as a belt drive.

As can be seen by further reference to FIg. 2, initially successive portions of belt 10 pass through charging station A. At charging station A, a corona discharge device such as a scorotron, corotron or dicorotron indicated generally by the reference numeral 24, charges the belt 10 to a selectively high uniform positive or negative potential, $V_0$. Any suitable control, well known in the art, may be employed for controlling the corona discharge device 24.

Next, the charged portions of the photoreceptor surface are advanced through exposure station B. At exposure station B, the uniformly charged photoreceptor or charge retentive surface 10 is exposed to a laser based input and/or output scanning device 25 which causes the charge retentive surface to be discharged in accordance with the output from the scanning device. Preferably the scanning device is a three level laser Raster Output Scanner (ROS). Alternatively, the ROS could be replaced by a conventional xerographic exposure device.

The photoreceptor, which is initially charged to a voltage $V_0$, undergoes dark decay to a level $V_{ddp}$ equal to about 900 volts. When exposed at the exposure station B it is discharged to $V_c$ equal to about 100 volts which is near zero or ground potential in the highlight (i.e. color other than black) color parts of the image. See FIG. 1*a*. The photoreceptor is also discharged to $V_w$ equal to approximately 500 volts imagewise in the background (white) image areas.

At development station C, a development system, indicated generally by the reference numeral 30 advances developer materials into contact with the electrostatic latent images. The development system 30 comprises first and second developer apparatuses 32 and 34. The developer apparatus 32 comprises a housing containing a pair of magnetic brush rollers 36 and 38. The rollers advance developer material 40 into contact with the latent images on the charge retentive surface which are at the voltage level $V_c$. The developer material 40 by way of example contains color toner and magnetic carrier beads. Appropriate electrical biasing of the developer housing is accomplished via power supply 41 electrically connected to developer apparatus 32. A DC bias of approximately 400 volts is applied to the rollers 36 and 37 via the power supply 41.

Figure 3A:
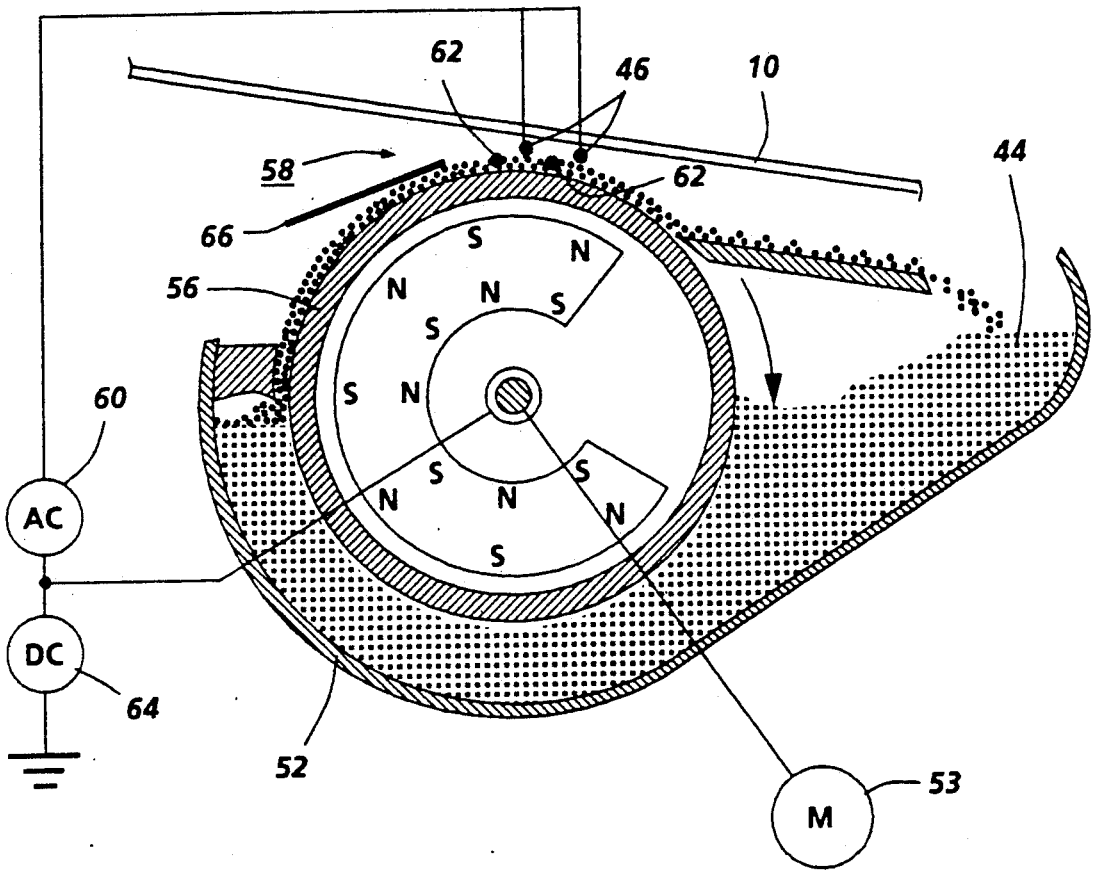
FIG. 3*a* is a fragmentary view of a carrier bead and toner particles attracted thereto.

The second developer apparatus 34 comprises a magnetic brush structure 42. The structure 42 conveys two-component developer 44 (FIGS. 3 and 3*a*) to an area adjacent an electrically biased electrode structure 46. A structure such as a flap 66 smooths the developer in the development zone where the magnetic field is tangential. By smoothing the developer layer, the electrically biased electrode structure 46 can be brought into close proximity with the developer layer. The two component developer in this case comprises a mixture containing black toner 48 and carrier beads 50 and is contained in a developer housing 52. The magnetic brush structure 42 can be rotated in either the 'with' or 'against' direction vis-a-vis the direction of motion of the charge retentive surface. Motor 53 is provided for this purpose. As indicated by the arrow in FIG. 3, the magnetic brush structure is rotated in the clockwise direction or in the same or with direction as the photoreceptor 10.

Figure 3B:
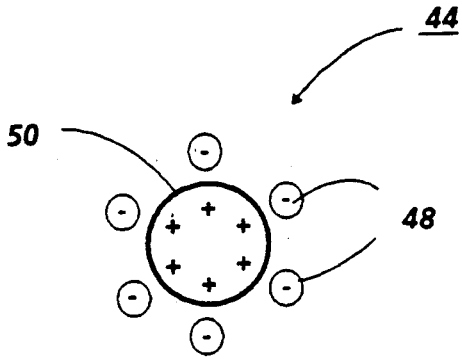
FIG. 3 is a fragmentary schematic illustration of a developer apparatus representing the present invention.

As disclosed in FIG. 3, the magnetic brush structure 42 comprises a stationary magnet structure 54 having north poles, N and south poles, S. The structure 42 further comprises a rotatable shell 56 in which the stationary magnet structure 54 is supported. The north and south poles of the magnet structure are arranged such that a tangential or low magnetic field is established in the nip 58 between the photoreceptor 10 and the magnetic brush structure 42. The provision of the tangential or low magnetic field in the nip precludes physical contact between the developer and the photoreceptor.

A typical electrode structure 46 comprises multiple conductive wires with diameters of 50 to 250 μm. An alternating electrical bias is applied to the electrode structure 46 via an AC voltage source 60. A typical AC bias of 600 to 1000 volts peak at a frequency of 1 to 10 kHz is applied to the electrodes (or to the roll with wires at a DC bias) which are in close proximity to a layer of insulative two-component developer. Conductive two-component developer could also be used provided the electrodes are overcoated with a sufficiently resistive yet relaxable layer to prevent electrical shorting. Auxiliary unbiased wires 62 alternately positioned adjacent the AC biased wires 46 provide developer agitation to provide a new supply of toner for each biased electrode 46 and dissipate any space charge electric field in the developer due to toner development.

The applied AC establishes an alternating electrostatic field between the wires 46 and the magnetic brush structure 42 which is effective in detaching toner from the surface of the carrier beads 50 and forming a toner cloud about the wires, the height of the cloud being such that the toner does not strongly interact with the charge retentive surface. A DC bias supply 64 which applies approximately 600 volts to the magnetic brush structure 42 establishes an electrostatic field between the charge retentive surface of the photoreceptor 10 and the magnetic brush structure for attracting the detached toner particles from the cloud surrounding the wires to the latent image on the charge retentive surface, which in the example herein is a CAD.

The spacing between the electrodes and developer layer is controlled and maintained for effective formation of a toner cloud. If the spacing is too large for the case of wire electrodes, the strength of the AC electric field is insufficient for detaching an appreciable amount of toner. If the wires are within the developer, a layer of developer interferes with the toner cloud formation. To control the spacing between the wires and developer a developer smoothing flap 66 is provided in contact with the developer. The flap material can be conducting or insulating.

The spacing between the electrodes and image receiver is typically 10 to 30 mils. The development of solid areas and lines is increased for the closer spacings.

The present invention was carried out utilizing a developer unit consisting of a single 3.2 cm diameter development roll. A tangential magnetic field of 300 gauss was positioned in the development zone. An AC bias of 800 volts peak at 5 kHz was applied to three 200 μm tungsten wires spaced apart by 0.25 cm. The developer consisting of 3.3% toner and 100 μm insulative carrier beads was metered onto the development roll moving at a speed of 20 cm/s. The charge-to-mass ratio of the developer was −10.6 μC/gm. The compressed pile height of the developer layer was approximately 600 μm. The spacings between both the wires and development roll and the wires and image receiver were 635 μm. The speed of the image receiver was 5 cm/s. The slope of the solid area development curve is essentially independent of the development roll speed. Supply limited development for high development potentials is proportional to the development speed ratio.

A noteworthy development characteristic of the present invention is the uniformity of the solid areas developed with a controlled toner cloud. This is a consequence of the noninteractive nature of the development. Toner cloud development of lines is characterized by line narrowing for low development potentials of comparable magnitude to the background cleaning potential. For higher line potentials, the line width is a more faithful representation of the electrostatic image.

A sheet of support material 68 (FIG. 2) is moved into contact with the toner image at transfer station D. The sheet of support material is advanced to transfer station D by conventional sheet feeding apparatus, not shown. Preferably, the sheet feeding apparatus includes a feed roll contacting the uppermost sheet of a stack copy sheets. Feed rolls rotate so as to advance the uppermost sheet from stack into a chute which directs the advancing sheet of support material into contact with photoconductive surface of belt 10 in a timed sequence so that the toner powder image developed thereon contacts the advancing sheet of support material at transfer station D.

Because the composite image developed on the photoreceptor consists of both positive and negative toner, a positive pre-transfer corona discharge member 70 is provided to condition the toner for effective transfer to a substrate using negative corona discharge.

Transfer station D includes a corona generating device 72 which sprays ions of a suitable polarity onto the backside of sheet 68. This attracts the charged toner powder images from the belt 10 to sheet 68. After transfer, the sheet continues to move, in the direction of arrow 74, onto a conveyor (not shown) which advances the sheet to fusing station E.

Fusing station E includes a fuser assembly, indicated generally by the reference numeral 76, which permanently affixes the transferred powder image to sheet 68. Preferably, fuser assembly 76 comprises a heated fuser roller 78 and a backup roller 80. Sheet 68 passes between fuser roller 78 and backup roller 80 with the toner powder image contacting fuser roller 78. In this manner, the toner powder image is permanently affixed to sheet 68. After fusing, a chute, not shown, guides the advancing sheet 68 to a catch tray, also not shown, for subsequent removal from the printing machine by the operator.

After the sheet of support material is separated from photoconductive surface of belt 10, the residual toner particles carried by the non-image areas on the photoconductive surface are removed therefrom. These particles are removed at cleaning station F. A magnetic brush cleaner housing 82 is disposed at the cleaner station F. The cleaner apparatus comprises a conventional magnetic brush roll structure for causing carrier particles in the cleaner housing to form a brush-like orientation relative to the roll structure and the charge retentive surface. It also includes a pair of detoning rolls for removing the residual toner from the brush.

Subsequent to cleaning, a discharge lamp (not shown) floods the photoconductive surface with light to dissipate any residual electrostatic charge remaining prior to the charging thereof for the successive imaging cycle.

While the developer apparatus 32 has been disclosed as a magnetic brush system, developer apparatus 34 could be used in its place. Also, while the development of discharged area images was illustrated as being effected prior to charged area development the sequence of image development can be reversed in the case where apparatus 34 is used in place of apparatus 32.

What is claimed is:

1. Apparatus for developing latent electrostatic images on a charge retentive surface with toner, said apparatus comprising:

a supply of two-component developer including toner and carrier beads;

a developer transport structure spaced from said charge retentive surface for conveying developer from said supply of developer to an area opposite said charge retentive surface without contacting said surface;

an electrode structure;

means for establishing an alternating electrostatic field between said developer transport structure and said electrode structure for creating a cloud of toner proximate said electrode structure;

said electrode structure comprising a plurality of wires operatively connected to an AC power source and being positioned in a space between said charge retentive surface and developer transport structure;

means for creating an electrostatic field between said charge retentive surface and said electrode structure for effecting movement of toner from said cloud of toner to said latent electrostatic images;

said transport structure comprising a magnetic brush structure having its north and south poles arranged such that the magnetic field established in said space is ineffective to cause said developer to contact said charge retentive surface; and a plurality of unbiased wires supported for agitation of of said developer on said magnetic brush structure.

2. Apparatus according to claim 1 including a member contacting said developer on said magnetic brush structure for controlling the spacing between said developer and said biased wires.

3. Apparatus according to claim 2 wherein said developer is conductive and said plurality of wires are overcoated with a sufficiently resistie yet charge relaxable layer.

4. Apparatus according to claim 1 wherein said alternating power source is in the order of 600 to 1000 volts peak at a frequency of 1 to 10 kHz.

5. Apparatus for developing latent electrostatic images on a charge retentive surface with toner, said apparatus comprising:

a supply of developer including toner and carrier beads;

a magnetic brush structure spaced from said charge retentive surface for conveying developer from said supply of developer to an area opposite said charge retentive surface;

an electrode structure;

means for establishing an alternating electrostatic field between said magnetic brush structure and said electrode structure for creating a cloud of toner proximate said electrode structure;

said electrode structure being positioned in a space between said charge retentive surface and said magnetic brush structure;

means for preventing the creation of a high radial magnetic field in said space for preventing contact between said charge retentive surface and said developer and means for creating an electrostatic field between said charge retentive surface and said electrode structure for effecting movement of toner from said cloud of toner to said latent electrostatic images.

6. Apparatus according to claim 5 wherein said electrode structure comprises a plurality of wires operatively connected to an AC power source.

7. Apparatus according to claim 6 including a plurality of unbiased wires supported for agitation of said developer on said magnetic brush structure.

8. Apparatus according to claim 7 including a member contacting said developer on said magnetic brush structure for controlling the spacing between said developer and said biased wires.

9. The method of forming highlight color images on a charge retentive surface containing at least two image areas, said method including the steps of:

providing first and second developer apparatuses;

positioning a developer transport structure of said second developer apparatus adjacent said charge retentive surface, said developer transport structure comprising a magnetic brush having its north and south poles arranged such that the magnetic field established in said space is ineffective to cause said developer to contact said charge retentive surface;

positioning an electrode structure in a space between said charge retentive surface and said electrode structure and spacing it a relatively short distance from the latter;

depositing two-component developer on said developer transport structure and conveying it to said space;

applying an alternating electrical bias to one of said structures to establish a relatively high alternating electrostatic field between said transport structure and said electrode structure to effect the formation of a cloud of toner around said electrode structure; and establishing an electrostatic field between said charge retentive surface and said donor structure for effecting movement of toner to said charge retentive surface to thereby render some of said latent electrostatic images visible.

10. The method according to claim 9 wherein said electrode structure comprises a plurality of wires operatively connected to an AC power source.

11. The method according to claim 10 including providing unbiased wires supported for agitation of said developer on said magnetic brush structure.

12. The method according to claim 11 including providing a member for contacting said developer on said magnetic brush structure for controlling the spacing between said developer and said biased wires.

13. The method according to claim 12 developer comprises insulative developer.

14. The method according to claim 13 wherein said developer is nonmagnetic.

* * * * *